US006374467B1

(12) United States Patent
Chen

(10) Patent No.: US 6,374,467 B1
(45) Date of Patent: Apr. 23, 2002

(54) MOVABLE BUCKLE DEVICE FOR LUGGAGE

(76) Inventor: Wei Chih Chen, No. 59, Hern-Junn Street, Da Chia Tseng, Taichung Hsien (TW)

( * ) Notice: Subject to any disclaimer, the term of this patent is extended or adjusted under 35 U.S.C. 154(b) by 0 days.

(21) Appl. No.: 09/655,572

(22) Filed: Sep. 6, 2000

(51) Int. Cl.[7] ..... A45C 5/14; A45C 13/10; B65D 63/00

(52) U.S. Cl. ..... 24/163 R; 24/3.13; 24/16 R; 24/181; 190/18 A; 190/102

(58) Field of Search ..... 24/163 R, 181, 24/164, 16 R, 17 B, 17 AP, 3.13; 190/18 A, 102, 108

(56) References Cited

U.S. PATENT DOCUMENTS 4,887,751 A * 12/1989 Lehman ..... 190/18 A
4,966,259 A * 10/1990 Bergman ..... 190/18 A
5,075,932 A * 12/1991 Hunt et al. ..... 24/16 PB
5,311,972 A * 5/1994 Plath ..... 190/102
5,501,308 A * 3/1996 King ..... 190/102
5,762,169 A * 6/1998 Deliman et al. ..... 190/18 A
5,944,155 A * 8/1999 Geary ..... 190/108

* cited by examiner

*Primary Examiner*—Victor N. Sakran
(74) *Attorney, Agent, or Firm*—Alan Kamrath; Rider, Bennett, Egan & Arundel, LLP

(57) ABSTRACT

A buckle device for luggage includes a male part connected to a belt on the luggage and a female part which is removably connected to a position member on the luggage. The female part has a hole and a recess respectively defined through a bottom plate thereof The recess is smaller than the hole. The position member has two flanges and the bottom plate is located between the two flanges. One of the flanges is larger than the recess and smaller than the hole. The buckle device is located transversely above a zipper device of the luggage. The zipper device is operated without separating the female part from the male part and simply disengaging the female part from the position member by allowing the flange passing through the hole.

6 Claims, 6 Drawing Sheets

MOVABLE BUCKLE DEVICE FOR LUGGAGE

FIELD OF THE INVENTION

The present invention relates to a buckle device on luggage wherein the female part is removably connected to a position member on a top of the luggage, and the male part is connected to a belt fixedly on the luggage. The female part can be disconnected from the position member to allow the user to use the zipper of the luggage.

BACKGROUND OF THE INVENTION

A conventional buckle device for luggage is shown in FIGS. 1 and 2 and generally includes a male part 30 which is connected to a first end of a belt 1, and a female part 20 fixedly connected to the base portion of a handle 10 which is fixedly connected to the luggage. A frame 2 is fixedly connected to the luggage and a second end of the belt 1 is connected to the frame 2. A hook is pivotally connected to the frame 2 so that an extra bag 3 is hooked to the hook. A zipper means 11 of the luggage passes right beside the base of the handle 10. The zipper means 11 is located below the female part 20 and the male part 30 which is connected to the female part 20 by inserting two prongs 31 into two slots 21 in the female part 20. When the user wants to use the zipper means 11 while the female part 20 is connected to the male part 30, the user does not want to disengage the male part 30 from the female part 20 because it requires a certain skill to press the prongs 31 inward and the extra bag 3 could drop because the belt 1 is loosened. It could hurt user's nails when pressing the prongs 31. Most users choose to lift the belt 1 so as to allow the movement of the zipper pull passing below the female part 20 and the male part 30. It takes a lot of effort to lift the belt 1.

FIG. 3 shows another embodiment of the buckle device for luggage wherein a loop of belt 22 is fixedly connected to the luggage and the female part 20 is connected to the belt 22. Therefore, the female part 20 is able to be lifted away from the zipper means 11 without separating from the female part 20 and the male part 30. Nevertheless, the user still has to use a lot of force to pull the belt 1 and 22 upward.

The present invention intends to provide a buckle device for luggage wherein the female part can be disconnected from the luggage to conveniently allow the zipper pull to pass.

SUMMARY OF THE INVENTION

In accordance with one aspect of the present invention, there is provided a buckle device for luggage and comprising a position member located on the luggage and a buckle assembly is removably connected to the position member. A belt has an end connected to the buckle assembly and the other end of the belt is connected to the luggage. The buckle assembly can be disengaged from the position member when using the zipper means of the luggage.

The primary object of the present invention is to provide a buckle assembly for luggage wherein the zipper can be used without lifting the belt connected to the buckle assembly.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 1:
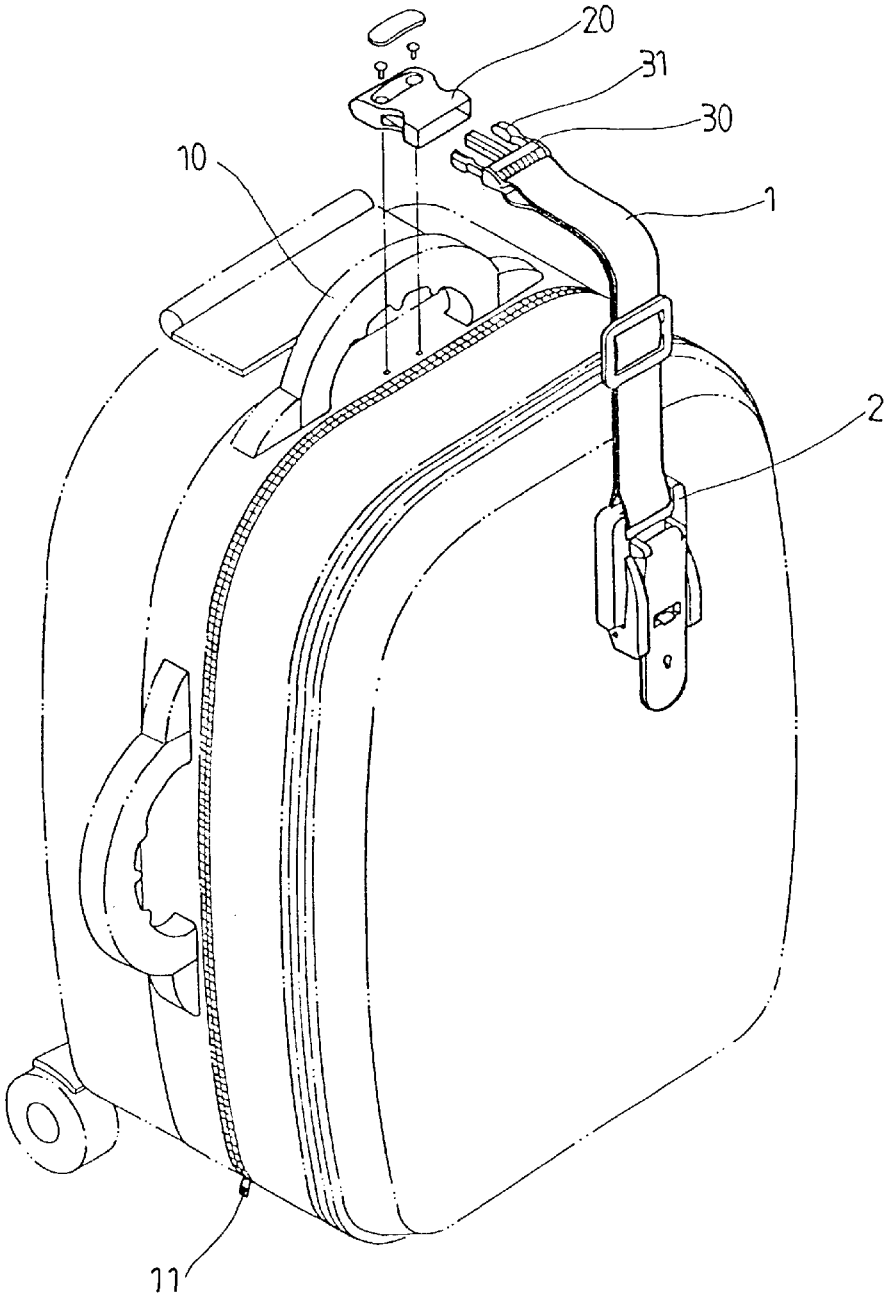
FIG. 1 PRIOR ART
FIG. 1 is an exploded view to show a conventional buckle device for luggage.
Figure 2:
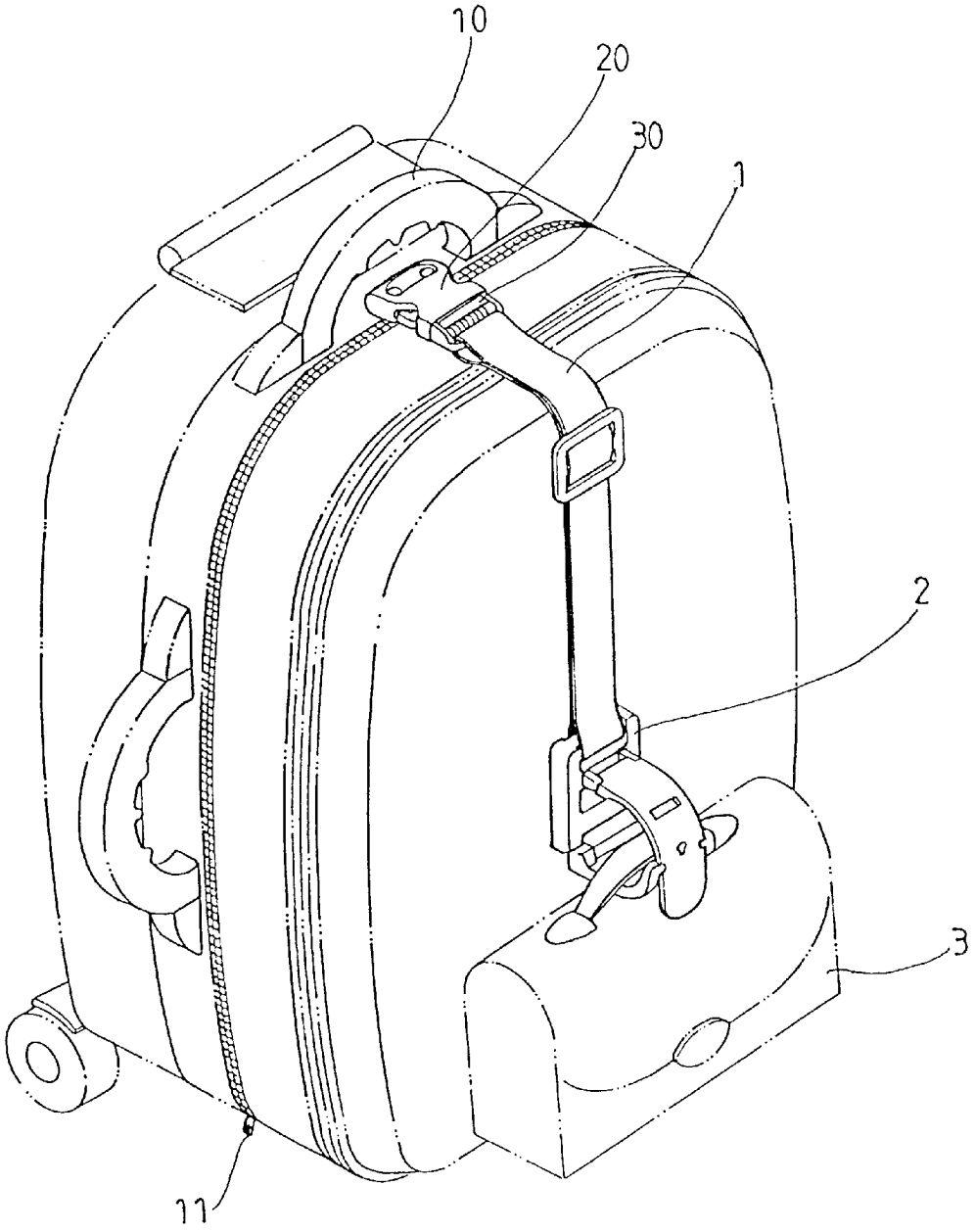
FIG. 2 PRIOR ART
FIG. 2 is a perspective view to show the buckle device in locked status on the luggage.
Figure 3:
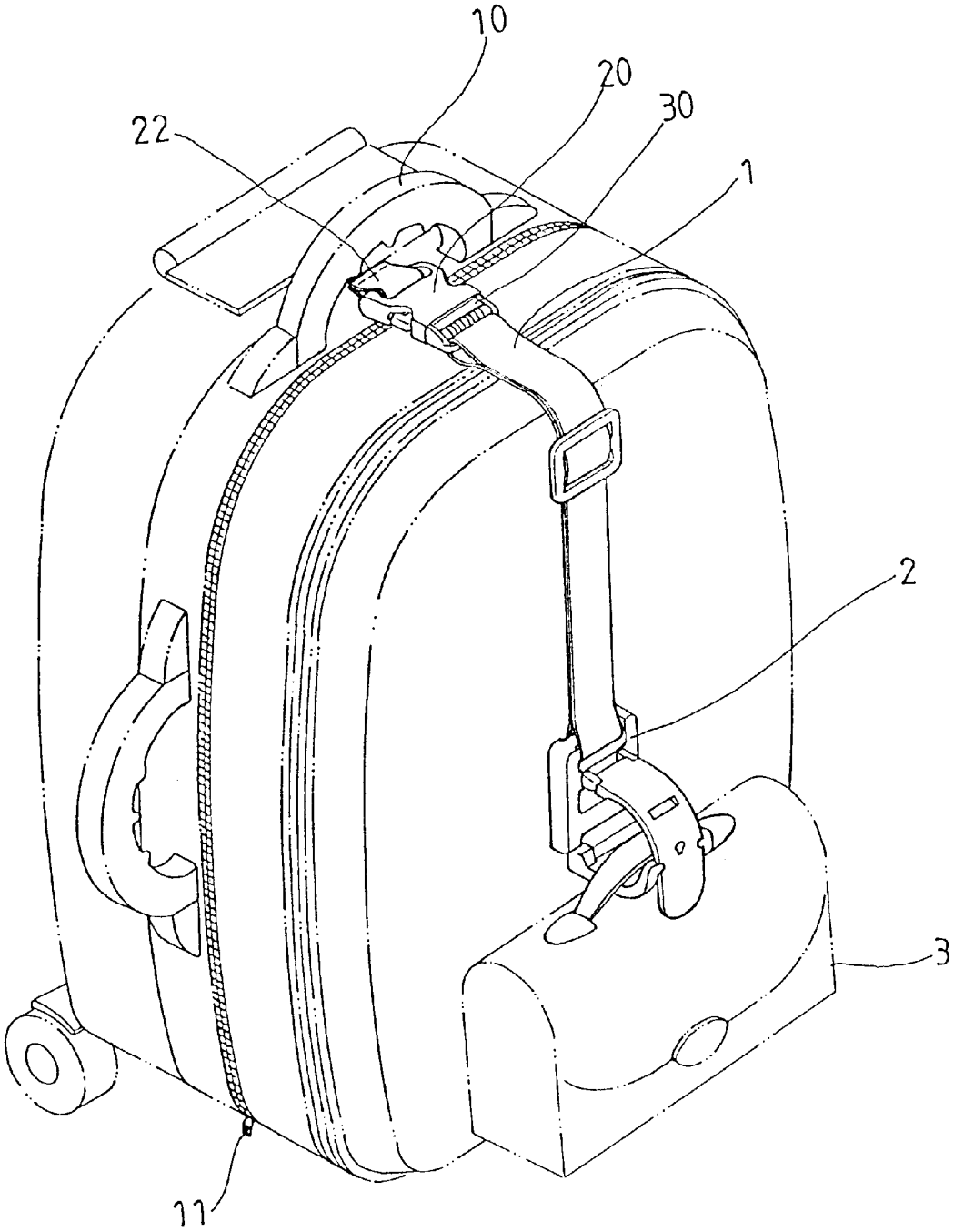
FIG. 3 PRIOR ART
FIG. 3 is a perspective view to show another conventional buckle device in locked status on luggage.
Figure 4:
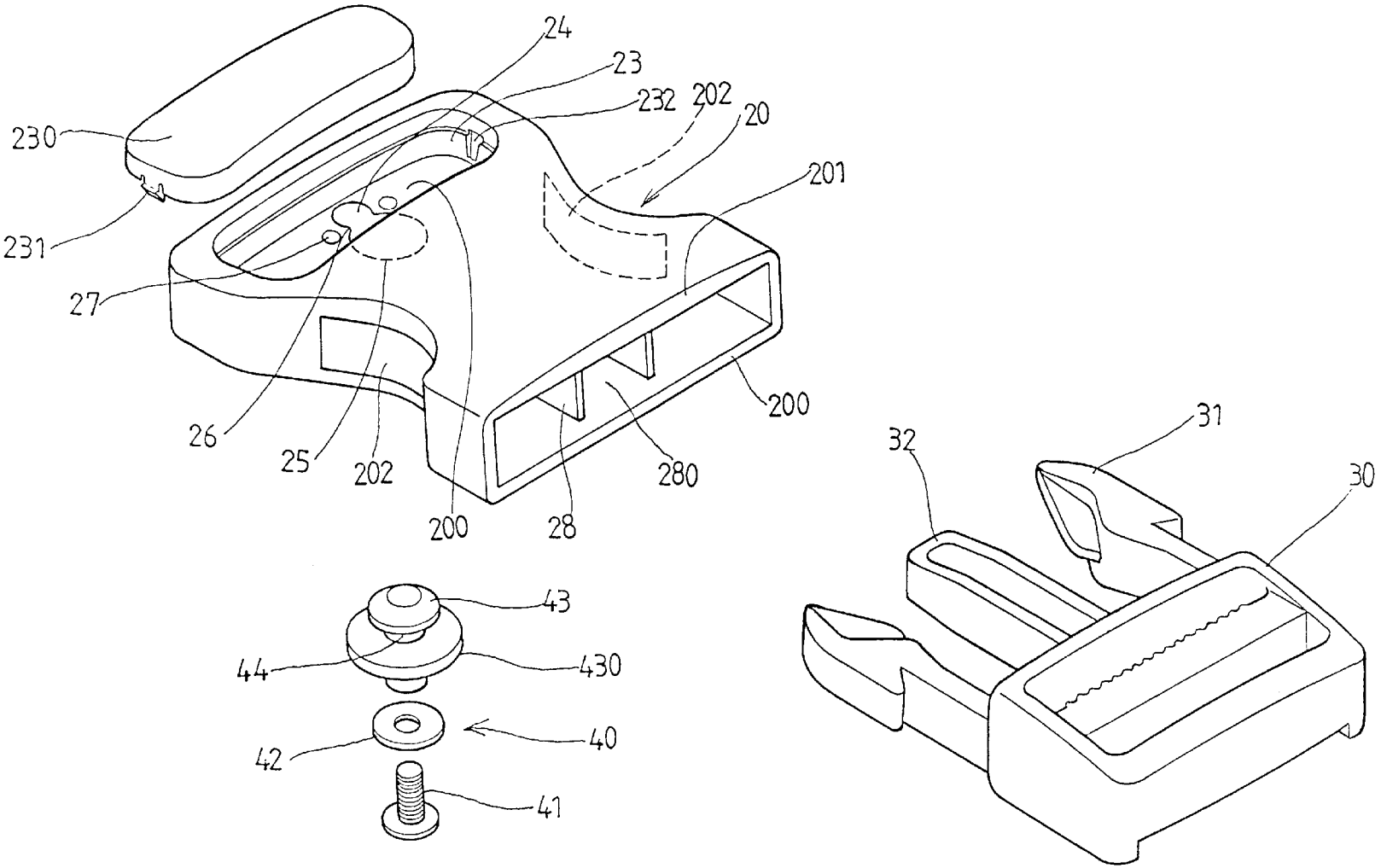
FIG. 4 is an exploded view to show a buckle assembly of the present invention.
Figure 5:
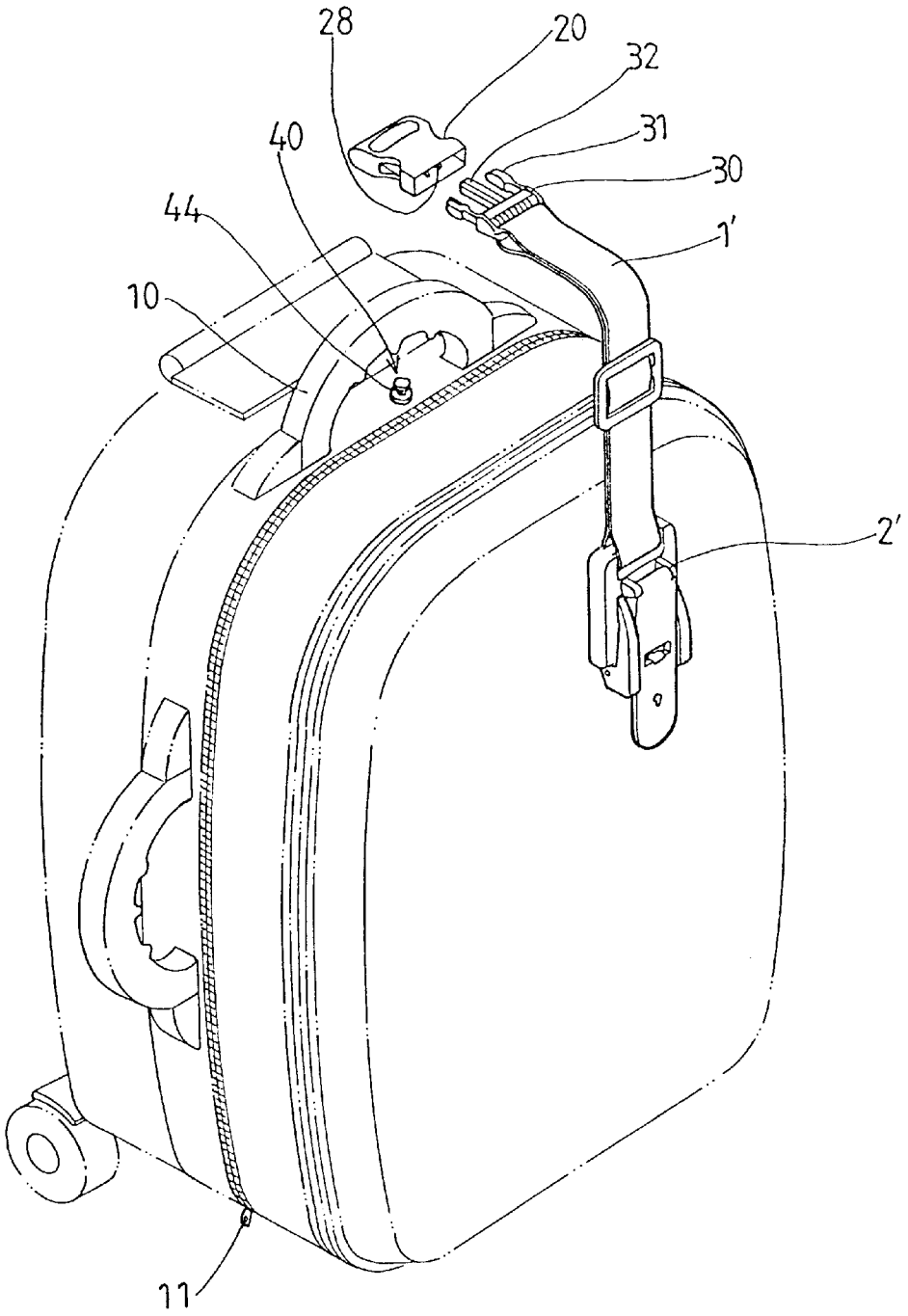
FIG. 5 is an exploded view to show the buckle assembly of the present invention.

Referring to FIGS. 4 and 5, the buckle device for luggage of the present invention comprises a position member 40 connected to the luggage and a buckle assembly is removably connected to the position member 40. The position member 40 includes a bolt 41 which extends through the luggage from inside of the luggage and is threadedly connected to a rod 44 with a washer 42 mounted to the bolt 41 and located between the luggage and the rod 44. The rod 44 has a first flange 43 and a second flange 430 respectively extending radially outward from the rod 44, wherein a diameter of the first flange 43 is smaller than a diameter of the second flange 430.

Figure 6:
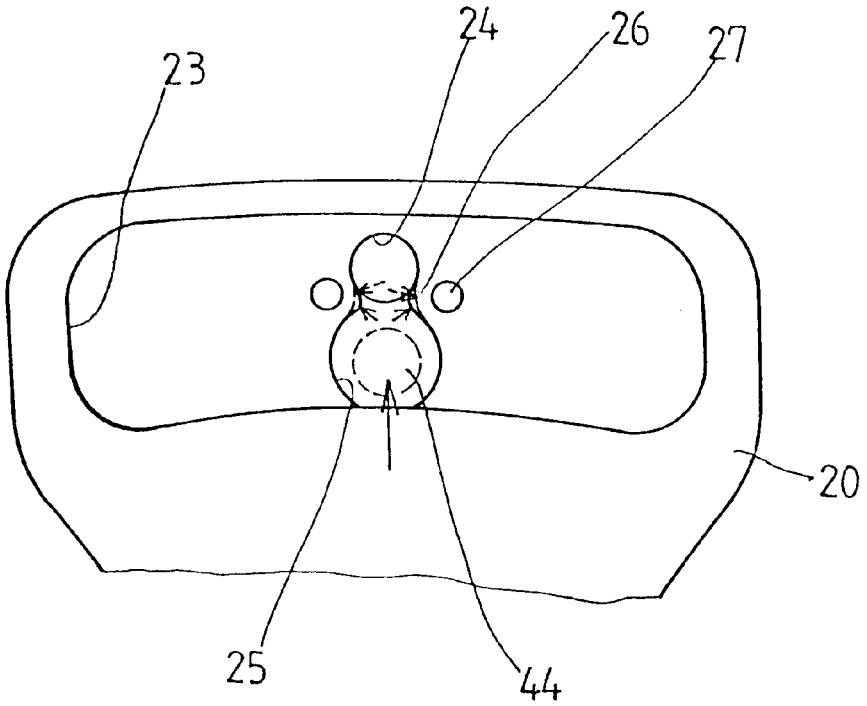
FIG. 6 is an illustrative view to show the female part of the buckle assembly is pulled and is ready for disengaging from the position member.

The buckle assembly comprises a female part 20 and a male part 30. A first end of the male part 30 is to a first end of a belt 1' which is fixedly connected to a frame 2'. A second end of the male part 30 has two prong 31 extending therefrom so as to be engaged with the female part 30. The female part 20 has a bottom plate 200, a top plate 201 and a peripheral wall connected between the top plate 201 and the bottom plate 200. An opening is defined in an end of the female part 20 so that the two prongs 31 extend in the opening and are engaged with two slots 202 defined through the peripheral wall of the female part 20. A hole 25 is defined through the bottom plate 200 and a recess 24 is defined in a periphery defining the hole 25 and communicates with the hole 25. The bottom plate 200 is located between the first flange 43 and the second flange 430, and a section of the rod 44 movably extends through the recess 24 and the hole 25. A diameter of the recess 24 is smaller than a diameter of the hole 25. The diameter of the first flange 43 is larger than the diameter of the recess 24, and smaller than the diameter of the hole 25. In other words, when the section of the rod 44 is located in the recess 24, the first flange 43 prevents the female part 20 from disengaging from the position member 40. When the female part 20 is pulled to let the section of the rod 44 located in the hole 25 as shown in FIG. 6, the female part 20 can be disengaged from the position member 40.

Two apertures 27 are defined through the bottom plate 200 and the recess 24 are located between the two apertures 27. The two apertures 27 are designed to let the connection portion 26 of the recess 24 and the hole 25 be more flexible so that when the section of the rod 44 is moved from the recess 24 into the hole 25, the rod 44 will not be jammed or stopped.

An access hole 23 is defined through the top plate 201 and communicates with the recess 24 and the hole 25 so that users may check the position member 40 via the access hole 23. A decorative board 230 is removably engaged with the access hole 23. Two lugs 231 extend from the decorative board 230 and two engaging recesses 232 are defined in an inside of the peripheral wall so that the two lugs 231 are engaged with the two engaging recesses 232.

A tongue member 32 extends from the male part 30 and two guide ribs 28 are connected between the top plate 201 and the bottom plate 200 of the female part 20 so that the tongue member 32 is guided and received between the two guide ribs 28 when connecting the female part 20 and the male part 30.

Accordingly, when using the zipper means 11 of the luggage, the user simply pulls the female part 20 and disengages the female part 20 from the position member 40, so that the user may conveniently pull the zipper pull.

While we have shown and described various embodiments in accordance with the present invention, it should be clear to those skilled in the art that further embodiments may be made without departing from the scope and spirit of the present invention.

What is claimed is:

1. A buckle device for luggage comprising:

a position member adapted to be connected to the luggage and a buckle assembly removably connected to said position member, and a belt having a first end connected to said buckle assembly and a second end of said belt adapted to be connected to the luggage, said buckle assembly comprising a female part and a male part, a first end of said male part connected to said first end of said belt and a second end of said male part engaged with said female part, said female part removably connected to said position member, said female part having a bottom plate, a top plate and a peripheral wall connected between said top plate and said bottom plate, an opening defined in an end of said female part so as to receive said male part which has two prongs extending from said second end of said male part, two slots defined through said peripheral wall of said female part and said two prongs engaged with said two slots, a hole defined through said bottom plate, a recess defined in a periphery defining said hole and communicating with said hole, a diameter of said recess being smaller than a diameter of said hole, said position member having a rod which is adapted to extend from the luggage, a first flange and a second flange respectively extending from said rod, said bottom plate located between said first flange and said second flange, a section of said rod movably extending through said recess and said hole, a diameter of said first flange being larger than said diameter of said recess, and being smaller than said diameter of said hole.

2. The device as claimed in claim 1 further comprising two apertures defined through said bottom plate and said recess located between said two apertures.

3. The device as claimed in claim 1 further comprising an access hole defined through said top plate and communicating with said recess and said hole, a decorative board removably engaged with said access hole.

4. The device as claimed in claim 3, wherein two lugs extend from said decorative board and two engaging recesses are defined in an inside of said peripheral wall, said two lugs engaged with said two engaging recesses.

5. The device as claimed in claim 1 further comprising two guide ribs connected between said top plate and said bottom plate of said female part, a tongue member extending from said male part and received between said two guide ribs.

6. The device as claimed in claim 1 further comprising a bolt which is adapted to extend through the luggage and threadedly connected to said rod.

* * * * *